US010507471B2

(12) United States Patent
Higuchi

(10) Patent No.: US 10,507,471 B2
(45) Date of Patent: Dec. 17, 2019

(54) GRAVITY SEPARATION DEVICE

(71) Applicant: SUMITOMO METAL MINING CO., LTD., Tokyo (JP)

(72) Inventor: Hirotaka Higuchi, Tokyo (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 75 days.

(21) Appl. No.: 15/758,510

(22) PCT Filed: Jun. 23, 2016

(86) PCT No.: PCT/JP2016/068634
§ 371 (c)(1),
(2) Date: Mar. 8, 2018

(87) PCT Pub. No.: WO2017/051578
PCT Pub. Date: Mar. 30, 2017

(65) Prior Publication Data

US 2018/0280991 A1 Oct. 4, 2018

(30) Foreign Application Priority Data

Sep. 25, 2015 (JP) ..... 2015-188780

(51) Int. Cl.
*B03B 5/62* (2006.01)
*B03B 13/00* (2006.01)
(Continued)

(52) U.S. Cl.
CPC ..... *B03B 5/623* (2013.01); *B03B 13/00* (2013.01); *C22B 1/00* (2013.01); *C22B 23/005* (2013.01); *B03B 9/00* (2013.01)

(58) Field of Classification Search
CPC B03B 5/623; B03B 13/00; C22B 1/00; C22B 23/005
(Continued)

(56) References Cited

U.S. PATENT DOCUMENTS 3,628,660 A * 12/1971 In't Veld ..... B01D 17/0214 210/104
2004/0217070 A1* 11/2004 Senior ..... B03B 7/00 210/787
(Continued)

FOREIGN PATENT DOCUMENTS

JP 59-013033 A 1/1984
JP 2000-325997 A 11/2000
(Continued)

OTHER PUBLICATIONS

International Search Report dated Sep. 20, 2016, issued for PCT/JP2016/068634.

*Primary Examiner* — Terrell H Matthews
(74) *Attorney, Agent, or Firm* — Locke Lord LLP; James E. Armstrong, IV; Nicholas J. DiCeglie, Jr.

(57) ABSTRACT

Provided is a gravity separation device wherein occurrences of shelving, flashing, and the like inside the device can be suppressed, variations in the flow rate of underflow obtained by gravity separation can be minimized and underflow can be stably extracted. This gravity separation device, which separates overflow and underflow using differences in specific gravity from mixed material, is provided with a separation section that has a supply pipe for supplying a slurry of the mixed material at the top and separates that slurry into overflow and underflow, and a deposition section that is positioned below the separation section and wherein the underflow that has been separated by precipitation is deposited. An extraction pipe for extracting the underflow is connected to the deposition section, and a valve for extracting the underflow and a metering pump for quantitatively extracting the underflow are provided in the extraction pipe.

8 Claims, 4 Drawing Sheets

(51) Int. Cl.
*B03B 9/00* (2006.01)
*C22B 1/00* (2006.01)
*C22B 23/00* (2006.01)

(58) Field of Classification Search
USPC ..... 209/158
See application file for complete search history.

(56) References Cited

U.S. PATENT DOCUMENTS

| | | | | |
|---|---|---|---|---|
| 2005/0265910 | A1 | 12/2005 | Kobayashi et al. | |
| 2014/0048470 | A1* | 2/2014 | Lalli | C02F 9/00 210/243 |
| 2016/0076121 | A1 | 3/2016 | Ohara et al. | |
| 2016/0367912 | A1* | 12/2016 | Kennedy | B01D 17/0214 |

FOREIGN PATENT DOCUMENTS

| | | | |
|---|---|---|---|
| JP | 2005-350766 | A | 12/2005 |
| JP | 2013-086015 | A | 5/2013 |
| JP | 2013-208587 | A | 10/2013 |
| WO | 2014/175093 | A1 | 10/2014 |

* cited by examiner

GRAVITY SEPARATION DEVICE

TECHNICAL FIELD

The present invention relates to a gravity separation device.

BACKGROUND ART

As a device separating particles having different specific gravities, there is mentioned a gravity separation device. As this gravity separation device, for example, a device in which a mixed material that is a target to be separated is supplied as slurry from an upper portion thereof, water is injected from the middle portion (incidentally, this water is referred to as "injected water"), and specific gravity separation of the slurry is performed by the upward flow of the injected water can be mentioned. Specifically, particles included in the mixed material are separated into the upper portion or a lower portion of the gravity separation device by a difference between the upward flow of the injected water and the precipitation rate of the precipitated particles.

As for separation control of the gravity separation device, a method of performing separation control by adjusting an opening degree of a bottom outlet valve with respect to a pressure meter provided on the wall surface of an upper portion of an addition line for injected water is general. Incidentally, as for the type of valves, a pinch valve or a butterfly valve is used.

However, in the inside of the gravity separation device, for example, shelving or flushing as shown in a dry hopper occurs, and it is difficult to supply, at a stable flow rate, an intermediate separated in the lower portion of the gravity separation device (hereinafter, referred to as "underflow") to be provided to a subsequent treatment step. Further, in a case where the flow rate of the separated underflow exceeds a controllable range, a problem also arises in that the slurry of the underflow overflows from a receiving tank (intermediary tank) provided continuously to the gravity separation device.

Patent Document 1 discloses a technique of a hydrometallurgical process for recovering nickel from nickel oxide ore using a high pressure acid leaching method in which abrasion of facilities caused by ore slurry is suppressed, the amount of a final neutralization residue is reduced, and impurity components are separated and recovered for recycling.

Specifically, disclosed is a hydrometallurgical process for nickel oxide ore based on a high pressure acid leaching method, the process including at least one step selected from Step A: separating and recovering chromite particles in ore slurry by a recovery process including a specific gravity separation method; Step B-1: carrying out a leaching treatment on ore slurry that has a lowered Cr grade and carrying out a neutralization treatment using a Mg-based neutralizer such as $Mg(OH)_2$ on a leachate obtained by solid-liquid separation; and Step B-2: carrying out a leaching treatment on ore slurry that has a lowered Cr grade and carrying out a neutralization treatment using a Mg-based neutralizer such as $Mg(OH)_2$ on leaching residue slurry obtained by solid-liquid separation to recover hematite particles.

However, this Patent Document 1 does not disclose at all that a predetermined amount of a concentrate obtained by using a specific gravity separation method is stably supplied to a subsequent treatment step.

Patent Document 1: Japanese Unexamined Patent Application, Publication No. 2005-350766

DISCLOSURE OF THE INVENTION

Problems to be Solved by the Invention

The present invention is proposed in view of such circumstances, and an object thereof is to provide a gravity separation device in which occurrence of shelving, flushing, and the like inside the device can be suppressed, variation in flow rate of an underflow obtained by specific gravity separation can be minimized, and the underflow can be stably discharged.

Means for Solving the Problems

The present inventors have conducted intensive studies, and as a result, have found that the aforementioned problems can be solved by providing a valve and a metering pump in a extraction pipe discharging an underflow separated by precipitation by a specific gravity in a gravity separation device. Thus, the present invention has been completed. That is, the present invention provides the following.

(1) A first invention of the present invention is a gravity separation device separating an overflow and an underflow using a difference in specific gravity from a mixed material including two or more types of particles having different specific gravities, the gravity separation device including: a separation section that has a supply pipe for supplying slurry of the mixed material to an upper portion and separates the slurry into an overflow and an underflow; and a deposition section that is positioned at the lower side of the separation section and in which the underflow separated by precipitation is deposited, in which a extraction pipe for discharging the underflow is connected to the deposition section, and a valve for discharging the underflow and a metering pump for quantitatively discharging the underflow are provided in the extraction pipe.

(2) A second invention of the present invention is the gravity separation device in the first invention, in which a pressure meter for measuring a pressure inside the separation section is provided in the separation section, and the metering pump controls a discharged amount of the underflow on the basis of a measurement value obtained by the pressure meter.

(3) A third invention of the present invention is the gravity separation device in the first or second invention, in which the slurry of the mixed material is ore slurry of nickel oxide ore.

Effects of the Invention

According to the present invention, the gravity separation device can discharge an underflow obtained by specific gravity separation at a stable flow rate and effectively suppress occurrence of shelving, flushing, and the like inside the device.

PREFERRED MODE FOR CARRYING OUT THE INVENTION

Hereinafter, a specific embodiment of the present invention (hereinafter, referred to as "the present embodiment") will be described in detail with reference to the drawings. Incidentally, the present invention is not limited to the following embodiment, and various modifications can be made within the range that does not change the spirit of the present invention. Further, in the present specification, the description "x to y" (x and y are arbitrary numerical values) means "x or more and y or less" unless otherwise specified.

<<1. Gravity Separation Device>>

A gravity separation device according to the present embodiment is a device which separates an overflow including particles with a small specific gravity and an underflow including particles with a large specific gravity using a difference in specific gravity from a mixed material including two or more types of particles having different specific gravities.

Figure 1:
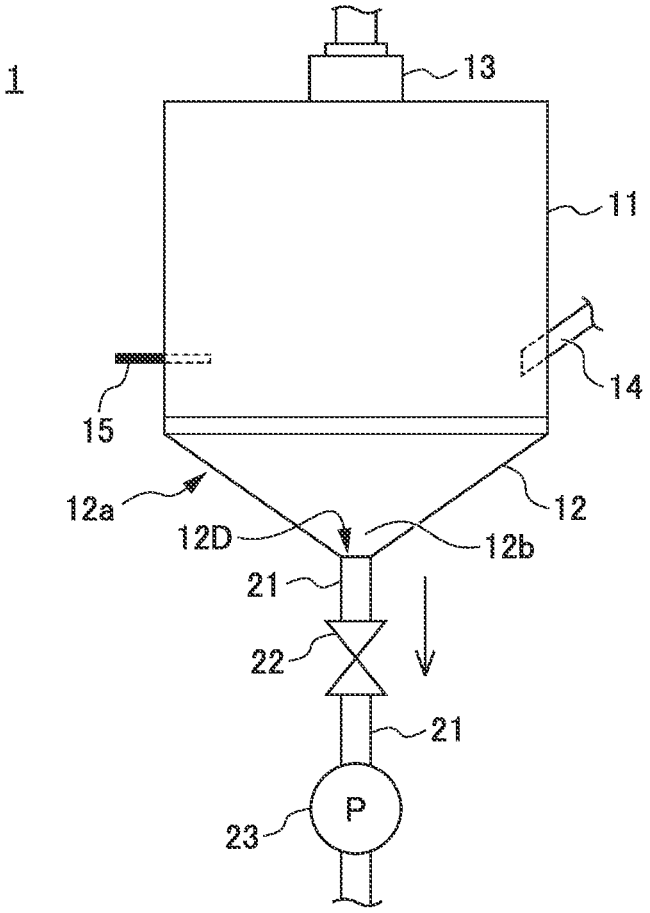
FIG. 1 is a diagram illustrating an example of the configuration of a gravity separation device.

FIG. 1 is a diagram illustrating an example of the configuration of a gravity separation device. As illustrated in FIG. 1, a gravity separation device 1 includes a separation section 11 that separates slurry of a mixed material including two or more types of particles having different specific gravities into an overflow and an underflow using a difference in specific gravity and a deposition section 12 in which the underflow separated by precipitation in the separation section 11 is deposited. Further, in this gravity separation device 1, a extraction pipe 21 for discharging the underflow separated by precipitation is connected to the deposition section 12, and a valve 22 for discharging the underflow and a metering pump 23 for quantitatively discharging the underflow are provided in this extraction pipe 21.

According to such a gravity separation device 1, when the underflow is discharged, the ON/OFF control of discharge can be performed by the valve 22 provided in the extraction pipe 21. Furthermore, since the metering pump is provided, the underflow can be quantitatively discharged when being discharged, and thus a predetermined amount can be stably discharged.

Accordingly, occurrence of troubles such as shelving and flushing in the gravity separation device 1 can be effectively prevented. Further, even in a case where the underflow separated by specific gravity is transferred, for example, to a tank, such as an intermediary tank, which is continuously provided, the underflow can be quantitatively transferred in a range in which the tank can accommodate the underflow, and occurrence of a situation in which the underflow transferred from the tank overflows can be prevented.

<1-1. Regarding Configuration of Gravity Separation Device>

[Separation Section]

In the separation section 11, the slurry of the mixed material including two or more types of particles having different specific gravities is separated into an overflow and an underflow using a difference in specific gravity. The separation section 11 configures a body portion of the gravity separation device 1 and has, for example, a tubular shape.

In the separation section 11, a supply pipe 13 through which the slurry of the mixed material including two or more types of particles having different specific gravities is supplied is provided at the upper portion thereof. Further, in the separation section 11, an injected water supply pipe 14 for supplying injected water is provided in the vicinity of the middle stage thereof.

Figure 2:
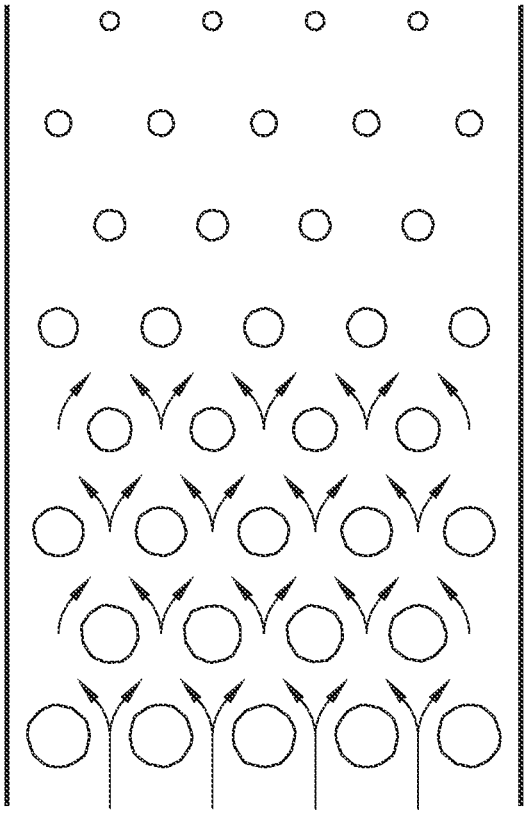
FIG. 2 is a diagram for describing a separation principle of two or more types of particles having different specific gravities in a separation section of the gravity separation device.

Herein, FIG. 2 is a diagram for describing a separation principle of two or more types of particles having different specific gravities in the separation section 11. In the separation section 11, as illustrated in FIG. 2, the injected water supplied from the vicinity of the middle stage of the separation section 11 flows upward to become upward flow, and specific gravity separation of the particles contained in the slurry is performed by a difference between the upward flow of the injected water and the precipitation rate of the precipitated particles. Specifically, large particles with a precipitation rate higher than the upward flow of the injected water are separated at the lower side of the separation section 11; meanwhile, small particles with a precipitation rate lower than the upward flow of the injected water are separated at the upper side of the separation section 11.

The slurry containing relatively large particles which has been separated in this way and moved to the lower side of the separation section 11 is precipitated and deposited in the deposition section 12 provided at the lower side of the separation section 11.

Incidentally, in the separation section 11, a pressure meter 15 that can measure a pressure inside the separation section 11 can be provided from the side wall thereof. Although the specific description thereof will be made below, when the underflow obtained by specific gravity separation in the separation section 11 is discharged through the extraction pipe 21, the discharged amount of the underflow by the metering pump 23 is determined on the basis of the pressure measurement value in the pressure meter 15, and the underflow is quantitatively discharged.

[Deposition Section]

The deposition section 12, as described above, is positioned at the lower side of the separation section 11 and the underflow separated by precipitation is deposited therein. The deposition section 12 is provided at the lower side sequentially to the separation section 11 and, for example, is formed in an inverted-conical shape in which a center portion 12*b* is disposed at a lower position in relation to a peripheral portion 12*a*.

Specifically, in the deposition section 12, the slurry containing relatively large particles separated in the separation section 11 is precipitated and gradually deposited. In the deposition section 12, an underflow discharge port 12D from which the deposited slurry is discharged as the underflow is provided at the inverted-conical center portion 12*b*, that is, a place positioned at the lowest side. Further, the extraction pipe 21 for discharging the underflow and then transferring the underflow to a treatment tank or the like provided sequentially to the gravity separation device 1 is connected to the underflow discharge port 12D.

[Extraction Pipe]

The extraction pipe 21 is connected to the underflow discharge port 12D from which the underflow deposited in the deposition section 12 as described above is discharged and discharges the underflow, and is a path through which the underflow is transferred to a treatment tank provided continuously to the gravity separation device 1.

In the extraction pipe 21, the valve 22 for discharging the underflow is provided. The valve 22 performs the ON/OFF control of discharge of the underflow and is configured, for example, by a pinch valve, a butterfly valve, or the like. This valve 22 is in a completely "closed" state when the operation of the gravity separation device 1 is stopped and the discharging of the underflow from the gravity separation device 1 is stopped. Accordingly, the underflow does not flow into the downstream side inside the extraction pipe 21 so that the underflow can be prevented from being solidified in the extraction pipe 21 and blocking the extraction pipe 21.

Further, in this extraction pipe 21, the metering pump 23 capable of controlling the discharged amount of the underflow in which discharge/non-discharge is controlled by the valve 22 and of discharging the underflow at a predetermined flow rate is provided. The metering pump can quantitatively discharge the underflow as described above and is configured, for example, by a hose pump or the like.

Specifically, the metering pump 23 controls the discharged amount of the underflow on the basis of the measurement value obtained by the pressure meter 15 provided in the separation section 11. As described above, by controlling the discharged amount of the underflow on the basis of the measurement value of the pressure meter 15, a certain amount of the underflow can be accurately extracted and discharged from the gravity separation device 1 at all times, and occurrence of shelving and flushing can be more effectively prevented. Incidentally, in the gravity separation device 1, a controller, which receives a signal of a pressure measurement value measured by the pressure meter 15 and transmits, to the metering pump 23, an instruction signal to perform the operation at such a rotation number that the discharged amount of the underflow becomes a predetermined discharged amount on the basis of the measurement value, may be separately provided.

In the gravity separation device 1, as described above, when the valve 22 for performing ON/OFF control of discharge and the metering pump 23 enabling quantitative discharge are provided in the extraction pipe 21 for discharging the underflow and the underflow separated by precipitation is quantitatively extracted at all times, occurrence of shelving and flushing inside the device can be suppressed.

Further, since the underflow can be quantitatively discharged, the underflow can be discharged and transferred at a stable flow rate to a treatment tank, a receiving tank (intermediary tank), or the like that is provided continuously to the gravity separation device 1 and the discharged amount can be controlled on the basis of an accommodation acceptable level of the treatment tank or the like. Accordingly, occurrence of a situation in which the underflow overflows from the treatment tank or the like can be effectively prevented.

Further, a second valve (not illustrated) is more preferably provided between the valve (for descriptive purposes, referred to as "first valve") 22 and the metering pump 23 in the extraction pipe 21. This second valve can be configured, for example, by a blowdown valve or the like. By providing such a second valve formed from a blowdown valve or the like, the underflow remaining in the extraction pipe 21 can be discharged. Specifically, in a case where the underflow remains in the extraction pipe 21, while the first valve 22 is fully closed and the second valve is fully opened, the metering pump 23 is operated in a reverse rotation. Accordingly, the underflow can be efficiently discharged through the second valve without back-flowing in the gravity separation device 1.

Incidentally, as for the gravity separation device 1, it is preferable not to provide a flocculant addition facility at the previous stage thereof. For example, in a case where a flocculant addition facility is provided at the previous stage of the device, like a solid-liquid separation device such as a thickener, a flocculant is loaded into the device. In the gravity separation device 1, as described above, injected water is supplied, and the specific gravity separation of particles in the slurry is performed by a difference between the upward flow of the injected water and the precipitation rate of the particles; however, in a state where a flocculant is loaded, aggregation of the particles occurs due to the flocculant and thus the specific gravity separation cannot be effectively performed.

<1-2. Regarding Slurry to be Treated in Gravity Separation Device>

The slurry to be treated, that is, the slurry of the mixed material including two or more types of particles having different specific gravities in the gravity separation device 1 according to the present embodiment is not particularly limited, but for example, ore slurry of nickel oxide ore can be mentioned.

Although the specific description thereof will be made below, in the hydrometallurgical process for nickel oxide ore, the nickel oxide ore serving as a raw material is classified at a predetermined classifying point so that oversized ore particles are removed, and then water is added to undersized ore particles to obtain ore slurry. The leaching treatment with sulfuric acid is carried out on the ore slurry. At this time, so-called gangue components having a low nickel grade such as chromite are also contained in the ore slurry serving as the target of the leaching treatment. By removing such components in advance, it is possible to smelt a nickel compound having a high nickel grade.

At this time, by carrying out the specific gravity separation treatment on the ore slurry using the gravity separation device 1 according to the present embodiment, components including chromite are condensed at the underflow that is a coarse particle fraction. According to this gravity separation device 1, even in a case where such ore slurry is used as a target to be treated, occurrence of shelving, flushing, and the like inside the device can be suppressed, and the underflow separated by specific gravity can be discharged at a stable flow rate.

Specifically, the ore slurry of nickel oxide ore is mainly slurry of laterite ore from a mineralogical perspective, and the percentage of ore particles contained in the slurry and having a particle size of −2000 μm (2000 μm or less) is 100% and the percentage of ore particles having a particle size of −75 μm (75 μm or less) is about 70% to 90%.

In particular, since the laterite ore contains clay and has a small particle size, shelving is likely to occur in the gravity separation device and flushing is likely to occur due to growth of the shelving. Even in a case where such ore slurry is used as a target of the specific gravity separation treatment, according to the gravity separation device 1, shelving and flushing can be effectively prevented.

<<2. Regarding Hydrometallurgical Process for Nickel Oxide Ore>>

The aforementioned gravity separation device 1 can be used, for example, in the treatment for preparing ore slurry to be provided to the leaching treatment, in the hydrometallurgical process of carrying out the leaching treatment to the nickel oxide ore to recover nickel.

<2-1. Outline of Method for Treating Ore Slurry>

Herein, the nickel oxide ore serving as a raw material to be treated in the hydrometallurgical process for nickel oxide ore is mainly so-called laterite ore such as limonite ore and saprolite ore. The content of nickel in the laterite ore is typically 0.8 to 2.5% by weight and nickel is contained as hydroxide or hydrous silica-magnesia (magnesium silicate) mineral. Further, the content of iron is 10 to 50% by weight and iron is mainly in the form of trivalent hydroxide (goethite); however, some divalent iron is contained in hydrous silica-magnesia mineral or the like. Furthermore, chromium is contained in laterite ore, and a major part of chromium components are contained as chromite mineral containing iron or magnesium, for example, in about 1 to 5% by weight. In addition, magnesia components are contained in silica-magnesia mineral that almost does not contain nickel, which is unweathered and has a high hardness value, in addition to the hydrous silica-magnesia mineral. Silicic acid components are contained in silica mineral such as quartz and cristobalite (amorphous silica), and hydrous silica-magnesia mineral.

As described above, chromite mineral, silica-magnesia mineral, and silica mineral contained in the laterite ore are so-called gangue components that almost do not contain nickel.

In the hydrometallurgical process, the nickel oxide ore serving as a raw material is mixed with water after the ore particle size is adjusted to prepare ore slurry, but chromite is contained in the nickel oxide ore as described above. From this point, it is known that when such ore slurry containing chromite is transferred using facilities such as pipes and pumps to be provided to the acid leaching treatment, these facilities are significantly worn.

From this reason, as the ore slurry to be provided to the acid leaching treatment, ore slurry from which chromite components are separated and removed before the acid leaching treatment is desirably used.

Figure 3:
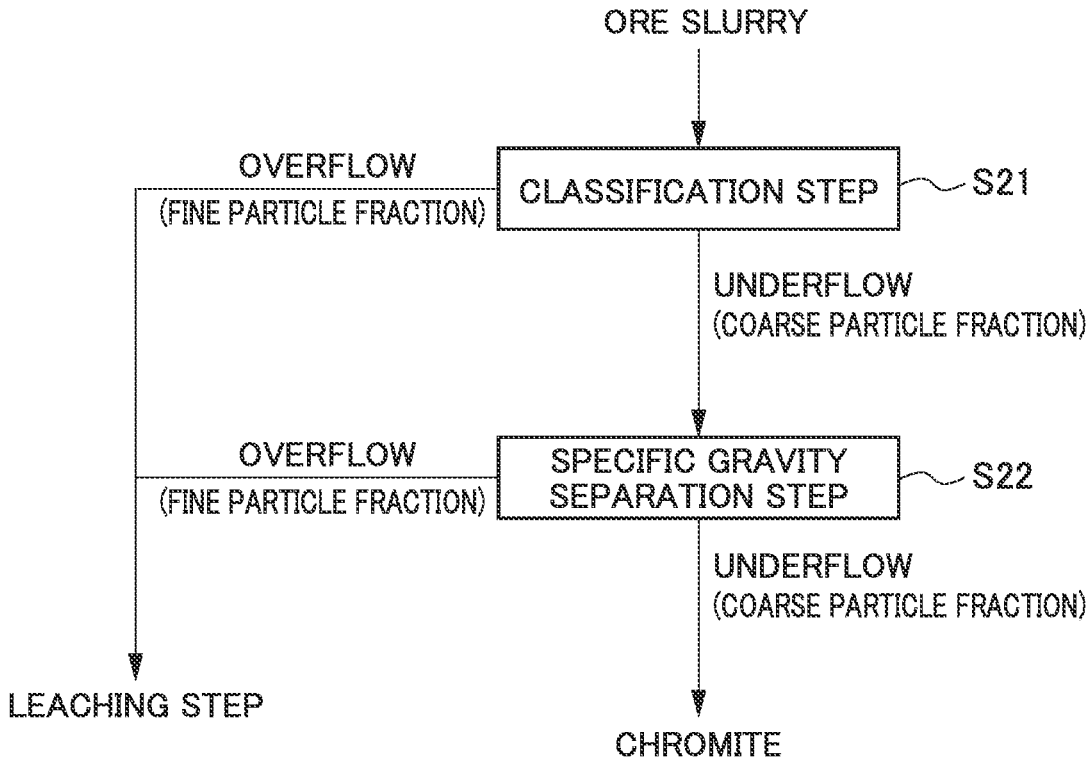
FIG. 3 is a process diagram illustrating an example of the flow of a method for treating ore slurry.

Specifically, as illustrated in the process diagram of FIG. 3, the process includes: a classification step S21 of carrying out a classification treatment using a hydrocyclone on the ore slurry of nickel oxide ore to separate a mixed material including goethite as an overflow and separate a mixed material including chromite as an underflow; and a specific gravity separation step S22 of performing a specific gravity separation treatment using a predetermined gravity separation device on the mixed material including chromite separated as an underflow in the classification step S21 and separating goethite included in the mixed material including chromite to obtain a mixed material including chromite condensed therein. In such a method for treating ore slurry, the aforementioned gravity separation device 1 can be suitably used in the treatment in the specific gravity separation step S22 in which chromite is condensed by performing the specific gravity separation treatment.

<2-2. Hydrometallurgical Process to which Method for Treating Ore Slurry>

Figure 4:
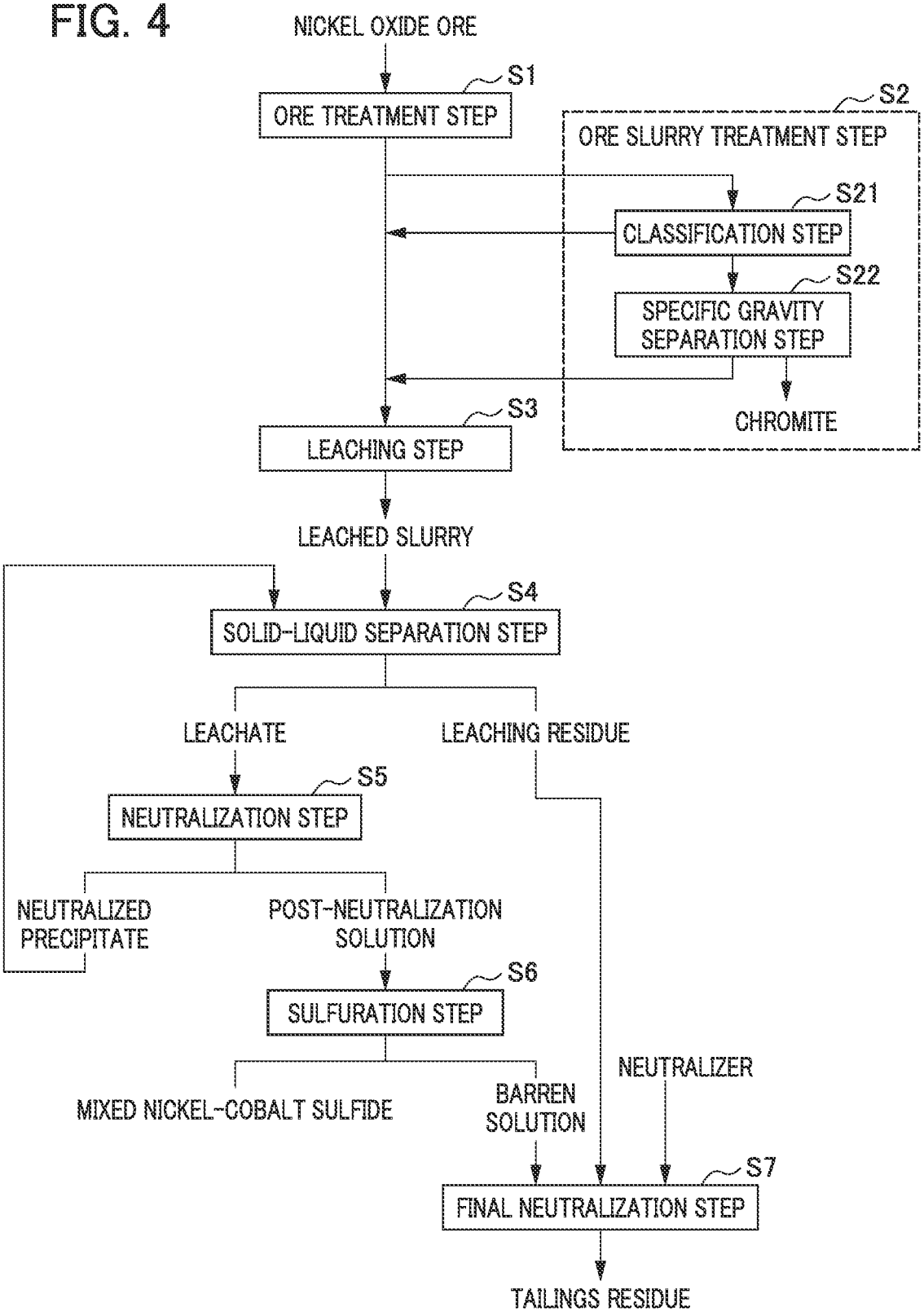
FIG. 4 is a process diagram illustrating an example of the flow of a hydrometallurgical process for nickel oxide ore.

FIG. 4 is a process diagram illustrating an example of the flow of a hydrometallurgical process for nickel oxide ore to which the aforementioned method for treating ore slurry is applied. This hydrometallurgical process for nickel oxide ore is, for example, a smelting process for leaching nickel to recover nickel from the nickel oxide ore by using a high pressure acid leaching method (HPAL method).

As illustrated in the process diagram of FIG. 4, the hydrometallurgical process for nickel oxide ore includes: an ore treatment step S1 for forming the nickel oxide ore as slurry; a leaching step S3 for performing an acid leaching treatment under high temperature and high pressure by adding sulfuric acid to the ore slurry; a solid-liquid separation step S4 for separating a residue while the obtained leached slurry is washed in multiple stages to obtain a leachate containing nickel and impurity elements; a neutralization step S5 for separating a neutralized precipitate containing impurity elements by adjusting the pH of the leachate to obtain a post-neutralization solution; and a sulfuration step S6 for generating a mixed sulfide containing nickel and cobalt (mixed nickel-cobalt sulfide) by adding a sulfurizing agent to the post-neutralization solution. Further, this hydrometallurgical process includes a final neutralization step S7 for recovering leaching residue slurry separated in the solid-liquid separation step S4 and a barren solution discharged in the sulfuration step S6 and detoxifying the leaching residue slurry and the barren solution to generate a final neutralization residue.

Further, in this hydrometallurgical process, it is characterized in that before carrying out the acid leaching treatment using sulfuric acid on the ore slurry, an ore slurry treatment step S2 for carrying out a treatment to remove chromite to the ore slurry slurried in the ore treatment step S1 is provided.

(1) Ore Treatment Step

In the ore treatment step S1, the nickel oxide ore serving as a raw material ore is classified at a predetermined classifying point so that oversized ore particles are removed, and then water is added to undersized ore particles to obtain ore slurry.

The method for classifying the nickel oxide ore is not particularly limited as long as it can classify ores on the basis of a desired particle diameter, and for example, the classification can be performed by sieve classification using a grizzly sieve, a vibration sieve, or the like. Further, the classifying point is not particularly limited, and a classifying point for obtaining ore slurry composed of ore particles having a desired particle diameter value or less can be appropriately set.

(2) Ore Slurry Treatment Step

In the present embodiment, before carrying out the acid leaching treatment on the ore slurry in the leaching step S3, a treatment of separating and removing chromite is carried out on the ore slurry obtained through the ore treatment step S1.

Specifically, this ore slurry treatment step S2 includes: the classification step S21 of carrying out a classification treatment on the ore slurry using a hydrocyclone to separate a mixed material including goethite as an overflow and separate a mixed material including chromite as an underflow; and the specific gravity separation step S22 of performing a specific gravity separation treatment using a predetermined gravity separation device on the mixed material including chromite as an underflow separated in the classification step S21 and separating goethite included in the mixed material including chromite to obtain a mixed material including chromite condensed therein.

At this time, in the specific gravity separation step S22, the treatment is performed using the aforementioned gravity separation device 1.

Further, in the ore slurry treatment step S2, sequentially to the specific gravity separation step S22, a second specific gravity separation treatment may be further performed using a gravity separation device on the mixed material including chromite separated by specific gravity to condense chromite as an underflow. The second specific gravity separation treatment can be also performed using the aforementioned gravity separation device 1.

(Classification Step)

In the classification step S21, the classification treatment is carried out using a hydrocyclone on the ore slurry of nickel oxide ore to separate a mixed material including goethite as an overflow (O/F) and separate a mixed material including chromite as an underflow (U/F). The mixed material including goethite classified as an overflow is ore slurry from which chromite is separated and removed, and is used as ore slurry to be provided to the acid leaching treatment, which is performed in a pressurized reaction vessel such as an autoclave of the hydrometallurgical process, without any change.

In general, the specific gravity of chromite is larger than the specific gravity of ferric hydroxide such as goethite. For this reason, by using a hydrocyclone as a classification apparatus, the mixed material including chromite as an underflow and the mixed material including goethite as an overflow can be accurately separated on the basis of the particle size of the ore slurry. Further, the hydrocyclone is suitable for treatment of a large amount of ore slurry and is suitable for treatment in a case where distribution to the overflow is large. Incidentally, the hydrocyclone may be provided with only one stage or plural stages of two or more stages.

(Specific Gravity Separation Step)

In the specific gravity separation step S22, the specific gravity separation treatment is performed using a predetermined gravity separation device on the mixed material including chromite separated as an underflow in the classification step S21 and goethite included in the mixed material including chromite is separated to obtain a mixed material including chromite condensed therein. At this time, as the gravity separation device, the aforementioned gravity separation device 1 can be used.

In the mixed material including chromite classified and separated as an underflow in the classification step S21, chromite is mainly included, but some of goethite is also included. In the specific gravity separation step S22, by carrying out the specific gravity separation treatment on such a mixed material including chromite, goethite and chromite can be further separated effectively. In other words, chromite can be further condensed. On the other hand, the mixed material including goethite separated by specific gravity can be used as ore slurry to be provided to the acid leaching treatment of the hydrometallurgical process.

By carrying out such a specific gravity separation treatment, chromite can be effectively removed and abrasion of facilities such as pipes and pumps caused by ore slurry to be supplied to the acid leaching treatment can be suppressed. Further, the $Cr_2O_3$ grade in the final neutralization residue produced from the final neutralization step in the hydrometallurgical process can be effectively reduced so that the residue amount thereof can be also effectively reduced.

Further, the underflow discharged from the gravity separation device by the specific gravity separation treatment is underflow in which chromite is condensed. When such underflow in which chromite is condensed is generated and the underflow is transferred to the subsequent treatment tank using the gravity separation device 1, the obtained underflow can be quantitatively supplied to the treatment tank.

(3) Leaching Step

In the leaching step S3, the acid leaching treatment, for example, using a high pressure acid leaching method is carried out on the ore slurry from which chromite is separated and removed through the ore slurry treatment step S2. Specifically, sulfuric acid is added to the ore slurry serving as a raw material in a pressurized reaction vessel such as an autoclave and the ore slurry is stirred while being pressurized under a high temperature condition of 220 to 280° C., preferably 240 to 270° C., thereby generating leached slurry composed of a leachate and a leaching residue.

(4) Solid-Liquid Separation Step

In the solid-liquid separation step S4, the leached slurry is separated into a leachate containing impurity elements in addition to nickel and cobalt and a leaching residue while the leached slurry obtained through the leaching step S3 is washed in multiple stages. In the solid-liquid separation step S4, for example, the leached slurry is mixed with a rinsing liquid and then subjected to the solid-liquid separation treatment by a solid-liquid separation facility such as a thickener.

(5) Neutralization Step

In the neutralization step S5, the pH of the leachate separated in the solid-liquid separation step S4 is adjusted and a neutralized precipitate containing impurity elements is separated to thereby obtain a post-neutralization solution containing nickel and cobalt. Specifically, in the neutralization step S5, a neutralizer such as calcium carbonate is added to the leachate while the oxidation of the separated leachate is suppressed such that the pH of the post-neutralization solution to be obtained is adjusted to 4 or less, preferably to 3.0 to 3.5, and more preferably to 3.1 to 3.2, thereby generating a post-neutralization solution and a neutralized precipitate slurry containing trivalent iron, aluminum, and the like as impurity elements. In the neutralization step S5, the impurities are removed as the neutralized precipitate in this way and a post-neutralization solution serving as a mother liquor for recovering nickel and cobalt is generated.

(6) Sulfuration Step

In the sulfuration step S6, the post-neutralization solution serving as a mother liquor for recovering nickel and cobalt is used as a sulfuration initial solution and hydrogen sulfide gas serving as a sulfurizing agent is blown into the sulfuration initial solution to cause a sulfuration reaction to occur, thereby generating a mixed sulfide containing nickel and cobalt with less impurity components (mixed nickel-cobalt sulfide) and a barren solution in which the concentration of nickel and cobalt is stabilized to a low level.

Incidentally, in a case where zinc is contained in the post-neutralization solution, before nickel and cobalt are separated as a sulfide, zinc can be selectively separated as a sulfide.

The sulfuration treatment in the sulfuration step S6 can be carried out using a sulfuration reaction tank or the like, hydrogen sulfide gas is blown into a gas phase portion in the reaction tank with respect to sulfuration initial solution loaded into the sulfuration reaction tank, sulfuration reaction is caused to occur by dissolving the hydrogen sulfide gas in the solution to occur. According to this sulfuration treatment, fixation of nickel and cobalt contained in the sulfuration initial solution as the mixed sulfide is performed. After completion of the sulfuration reaction, the slurry containing the obtained mixed nickel-cobalt sulfide is loaded into a solid-liquid separation device such as a thickener to carry out a precipitation and separation treatment, and only the mixed sulfide is separated and recovered from the bottom portion of the thickener.

Incidentally, the aqueous solution components separated through the sulfuration step S6 are overflowed and recovered as a barren solution from the upper portion of the thickener. The recovered barren solution is a solution having an extremely low concentration of valuable metals such as nickel and contains impurity elements such as iron, magnesium, and manganese remaining without being sulfurized. This barren solution is transferred to the final neutralization step S7 and subjected to a detoxification treatment.

(7) Final Neutralization Step

In the final neutralization step S7, a neutralization treatment (a detoxification treatment) to adjust the pH to a predetermined pH range satisfying the discharge standard is carried out on the leaching residue separated by the solid-liquid separation treatment in the solid-liquid separation step S4 described above, the barren solution recovered in the sulfuration step S6 and containing impurity elements such as iron, magnesium, and manganese, and the like. A method for adjusting the pH is not particularly limited, but for example, the pH can be adjusted to a predetermined range by adding a neutralizer such as calcium carbonate. According to the neutralization treatment using such a neutralizer, a final neutralization residue is generated and stored in a tailings dam. Meanwhile, a solution obtained after the neutralization treatment satisfies the discharge standard and is discharged to the outside of the system.

EXAMPLES

Hereinafter, the present invention will be described in more detail by means of Examples, but the present invention is not limited to the following Examples at all.

Example 1

A hydrometallurgical treatment for nickel oxide ore formed from the process diagram illustrated in FIG. 4 was performed. That is, as a treatment step for ore slurry of nickel oxide ore, ore slurry obtained by slurrying nickel oxide ore having a composition presented in the following Table 1 was supplied to a hydrocyclone (manufactured by Salter Cyclones Ltd., SC1030-P type) to be subjected to a classification and separation treatment.

TABLE 1

| | Ni [%] | Mg [%] | Solid [t/h] | <45 μm [%] |
|---|---|---|---|---|
| Nickel oxide ore | 0.91 | 1.59 | 60 | 89.0 |

Subsequently, a density separator was used as the gravity separation device and the underflow discharged from the hydrocyclone was supplied to the density separator to be subjected to a specific gravity separation treatment. At this time, a density separator having the configuration as illustrated in FIG. 1 was used as the density separator, and a butterfly valve for performing ON/OFF control of discharge of the underflow and a hose pump (manufactured by Bredel, BRD-80 type) serving as a metering pump were provided in the extraction pipe discharging the underflow to the bottom portion. Further, a pressure meter was loaded and installed in the separation section of the density separator from the wall surface thereof so that the pressure inside the separation section can be measured.

The specific gravity separation treatment was performed using such a gravity separation device, and then the ore slurry of the overflow was provided to the leaching treatment in the hydrometallurgical process; meanwhile, the slurry of the underflow in which chromite is condensed was transferred to a subsequent treatment tank. When the underflow was transferred to the treatment tank, the underflow was transferred such that the transferred amount thereof was adjusted to have a density in the gravity separation device of 1.35 g/cm$^3$ on the basis of the measurement value of the pressure meter provided in the density separator. Incidentally, the density refers to a density of a portion at the upper side in relation to the place at which the pressure meter is provided.

As a result, it was possible to stably transfer the slurry from the gravity separation device without variation in flow rate. Further, as a result of stabilization of the flow rate, a situation in which the underflow overflows from the receiving tank (intermediary tank) that is a destination of the underflow to be transferred did not occur at all. Furthermore, there was no need of monitoring by an operator, except for regular patrol, and thus it was possible to perform efficient operation.

Comparative Example 1

In Comparative Example 1, the operation was performed in the same manner as in Example 1, except that a device not provided with a metering pump in the extraction pipe for the underflow was used as the density separator serving as the gravity separation device. Incidentally, when the underflow was transferred, the operation was performed while the opening degree of the butterfly valve was controlled such that the transferred amount of the underflow was adjusted to have a density in the gravity separation device of 1.35 g/cm$^3$ on the basis of the measurement value of the pressure meter provided on the wall surface of the density separator.

As a result, in the configuration of the gravity separation device of Comparative Example 1, flushing occurred at a frequency of 2 to 3 times for 1 hour, it was not possible to discharge and transfer the underflow at a stable flow rate, and a situation in which the underflow overflows from the receiving tank occurred at a frequency of 60 times/day. Further, according to this, cleaning was necessary in each case, and thus arrangement of a dedicated manpower was required.

Comparative Example 2

In Comparative Example 2, the operation was performed while a device not provided with a metering pump in the extraction pipe for the underflow was used as the density separator serving as the gravity separation device and the opening degree of the butterfly valve was controlled such that the transferred amount of the underflow was adjusted to have a density in the gravity separation device of 1.45 g/cm$^3$ on the basis of the measurement value of the pressure meter provided on the wall surface of the density separator.

As a result, in Comparative Example 2, the frequency at which flushing occurred was temporarily reduced, but a solid matter was condensed in the density separator so that shelving occurred. According to this, an indication of the pressure meter abruptly increased, the opening degree of the bottom outlet valve increased, and thus the flow rate of the underflow rapidly increased. Further, since it was not possible to transfer the underflow at a stable flow rate, a situation in which the underflow overflows from the receiving tank occurred at a frequency of 2 to 3 times for 1 hour and 60 times/day on average per day.

Comparative Example 3

In Comparative Example 3, the operation was performed while a device not provided with a metering pump in the extraction pipe for the underflow was used as the density separator serving as the gravity separation device and the opening degree of the butterfly valve was controlled such that the transferred amount of the underflow was adjusted to have a density in the gravity separation device of 1.45 g/cm$^3$ on the basis of the measurement value of the pressure meter provided on the wall surface of the density separator. Further, a monitoring person was arranged and, in a case where flushing occurred, the operation mode was changed to manual operation to decrease the opening degree of the butterfly valve, and then after flushing receded, the operation for changing the operation mode to automatic control was performed.

As a result, in Comparative Example 3, although it was possible to suppress the influence of flushing, a situation in which the underflow overflows from the receiving tank occurred at a frequency of one time for 1 hour and 24 times/day on average per day. Incidentally, since a monitoring person was arranged, obviously, it was not possible to perform efficient operation.

EXPLANATION OF REFERENCE NUMERALS

1 Gravity separation device
11 Separation section
12 Deposition section
21 Extraction pipe
22 Valve (ON/OFF valve)
23 Metering pump

The invention claimed is:

1. A gravity separation device separating an overflow and an underflow using a difference in specific gravity from a slurry of laterite ore including two or more types of ore particles having different specific gravities, wherein the percentage of ore particles contained in the slurry and having a particle size of 2000 μm or less is 100% and the percentage of ore particles contained in the slurry and having a particle size of 75 μm or less is 70% to 90%, the gravity separation device comprising:

a separation section that has a supply pipe for supplying the slurry of laterite ore to an upper portion and separates the slurry into an overflow and an underflow; and a deposition section that is positioned at the lower side of the separation section and in which the underflow separated by precipitation is deposited, wherein a pressure meter for measuring a pressure inside the separation section is provided in the separation section, an extraction pipe for discharging the underflow is connected to the deposition section, a valve for discharging the underflow and a metering pump for quantitatively discharging the underflow are provided in the extraction pipe, and the metering pump controls a discharged amount of the underflow on the basis of a measurement value obtained by the pressure meter.

2. The gravity separation device according to claim 1, wherein a controller, which receives a signal of a pressure measurement value measured by the pressure meter and transmits, to the metering pump, an instruction signal to perform the operation at such a rotation number that the discharged amount of the underflow becomes a predetermined discharged amount on the basis of the measurement value, is further provided.

3. The gravity separation device according to claim 1, wherein a second valve is provided between the valve and the metering pump in the extraction pipe.

4. The gravity separation device according to claim 2, wherein a second valve is provided between the valve and the metering pump in the extraction pipe.

5. The gravity separation device according to claim 1, wherein an injected water supply pipe for supplying injected water is provided in the vicinity of the middle stage thereof and the injected water supplied from the injected water supply pipe flows upward to become upward flow, and specific gravity separation of the ore particles contained in the slurry of laterite ore is performed by a difference between the upward flow of the injected water and the precipitation rate of the precipitated particles.

6. The gravity separation device according to claim 2, wherein an injected water supply pipe for supplying injected water is provided in the vicinity of the middle stage thereof and the injected water supplied from the injected water supply pipe flows upward to become upward flow, and specific gravity separation of the ore particles contained in the slurry of laterite ore is performed by a difference between the upward flow of the injected water and the precipitation rate of the precipitated particles.

7. The gravity separation device according to claim 3, wherein an injected water supply pipe for supplying injected water is provided in the vicinity of the middle stage thereof and the injected water supplied from the injected water supply pipe flows upward to become upward flow, and specific gravity separation of the ore particles contained in the slurry of laterite ore is performed by a difference between the upward flow of the injected water and the precipitation rate of the precipitated particles.

8. The gravity separation device according to claim 4, wherein an injected water supply pipe for supplying injected water is provided in the vicinity of the middle stage thereof and the injected water supplied from the injected water supply pipe flows upward to become upward flow, and specific gravity separation of the ore particles contained in the slurry of laterite ore is performed by a difference between the upward flow of the injected water and the precipitation rate of the precipitated particles.

* * * * *